US008449720B2

(12) United States Patent
Ekman et al.

(10) Patent No.: US 8,449,720 B2
(45) Date of Patent: May 28, 2013

(54) METHOD OF MAKING PAPER

(75) Inventors: Kalle Ekman, Imatra (FI); Heini Eskola, Joutseno (FI); Antti Korpela, Helsinki (FI)

(73) Assignee: Stora Enso Oyj, Helsinki (FI)

( * ) Notice: Subject to any disclaimer, the term of this patent is extended or adjusted under 35 U.S.C. 154(b) by 0 days.

(21) Appl. No.: 13/377,315

(22) PCT Filed: Jun. 17, 2010

(86) PCT No.: PCT/FI2010/000042

§ 371 (c)(1),
(2), (4) Date: Dec. 21, 2011

(87) PCT Pub. No.: WO2010/146223

PCT Pub. Date: Dec. 23, 2010

(65) Prior Publication Data

US 2012/0090798 A1 Apr. 19, 2012

(30) Foreign Application Priority Data

Jun. 18, 2009 (FI) ..... 20095697

(51) Int. Cl.

| | |
|---|---|
| ***D21B 1/06*** | (2006.01) |
| ***D21B 1/14*** | (2006.01) |
| ***D21D 1/20*** | (2006.01) |
| ***D21H 11/16*** | (2006.01) |

(52) U.S. Cl.
USPC ..... 162/149; 162/18; 162/19; 162/55; 162/147; 241/21

(58) Field of Classification Search
USPC ..... 162/18, 19, 27, 55–56, 141–142, 162/147, 149; 241/20–21
See application file for complete search history.

(56) References Cited

U.S. PATENT DOCUMENTS

| | | | | |
|---|---|---|---|---|
| 3,382,140 | A * | 5/1968 | Henderson et al. | 162/28 |
| 3,406,088 | A * | 10/1968 | Stengle et al. | 162/125 |
| 5,145,010 | A * | 9/1992 | Danielsson et al. | 162/26 |
| 6,156,118 | A * | 12/2000 | Silenius | 106/501.1 |
| 6,174,412 | B1 | 1/2001 | Paterson-Brown et al. | |
| 6,361,650 | B1 * | 3/2002 | Danielsson et al. | 162/28 |
| 6,818,099 | B2 * | 11/2004 | Tienvieri et al. | 162/56 |
| 7,857,906 | B2 * | 12/2010 | Luo et al. | 106/730 |
| 2005/0061455 | A1 | 3/2005 | Tan et al. | |
| 2009/0032207 | A1 * | 2/2009 | Laurila-Lumme et al. | 162/55 |
| 2012/0061044 | A1 * | 3/2012 | Scherb et al. | 162/289 |
| 2012/0090798 | A1 * | 4/2012 | Ekman et al. | 162/100 |
| 2012/0227633 | A1 * | 9/2012 | Laukkanen et al. | 106/805 |

FOREIGN PATENT DOCUMENTS

| | | | |
|---|---|---|---|
| EP | 0 693 915 | B1 | 9/1999 |
| EP | 0 964 301 | B1 | 12/1999 |
| EP | 0 979 895 | | 2/2000 |
| WO | WO 2010106234 | A1 * | 9/2010 |
| WO | WO 2010146223 | A1 * | 12/2010 |

OTHER PUBLICATIONS

Minor, James L. and Atalla, Rajai H. "Strength Loss in Recycled Fibers and Methods of Restoration." Material Research Society Symposium Proceedings, vol. 266, 1992.

Fernando, Dinesh; Rosenberg, Peter; Persson, Erik; Daniel, Geoffrey. "Fibre Development during Stone Grinding; Ultrastructural Characterization for Understanding Derived Properties," 2007.

Jo, M., Takatsu, A., Sakurai, M., Takagi, T. "High Consistency Refining of Dry Cut Non Wood Pulp." 1983 International Symposium on Wood and Pulping Chemistry. vol. 2, 1983.

Koljonen, Tuulikki and Heikkurinen, Annikki. "Characterization of Refining Effects of Deinked Pulp." PTS Deinking Symposium 1994.

Askling, C., Wagberg, L, and Rigdahl, M. "Effects of the Process Conditions During Dry-Defibration on the Properties of Cellulosic Networks." Journal of Materials Science. No. 33, 1998, p. 2005-2012.

Body Conversion Chart, http://www.aikagroup.com/html/body_conversion1.html, May 11, 2010.

Yli-Viitala P, Ämmälä A., & Niinimäki J. "Defibering of paper in a dry content of fifty percent and higher." 60th Appita Annual Conference, Melbourne, Australia, Apr. 3-5, 2006, pp. 75-80.

Grandmaison, E.W. and Gupta, A. "Fibrillation of Wood Pulp in the Dray State", TAPPI J. 69 (Aug. 1986), No. 8, 110, pp. 110-113.

* cited by examiner

*Primary Examiner* — Jose A Fortuna
(74) *Attorney, Agent, or Firm* — Greer Burns & Crain, Ltd.

(57) ABSTRACT

The invention relates to a method of making a paper or paper board, in which method cut pulp is prepared by cutting basic cellulosic fiber pulp at the consistency of at least 25% so that the average fiber length of the basic pulp is decreased by more than 25% and the SR number of the cut pulp is at most 20% higher than that of the basic pulp, and the cut pulp is used as a raw material in the preparation of a stock.

20 Claims, 2 Drawing Sheets

Figure 1:
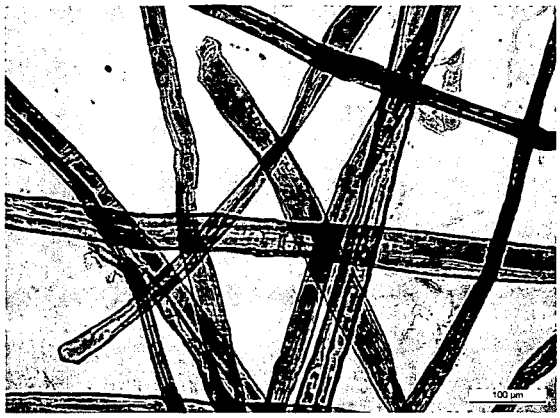
Figure 1:
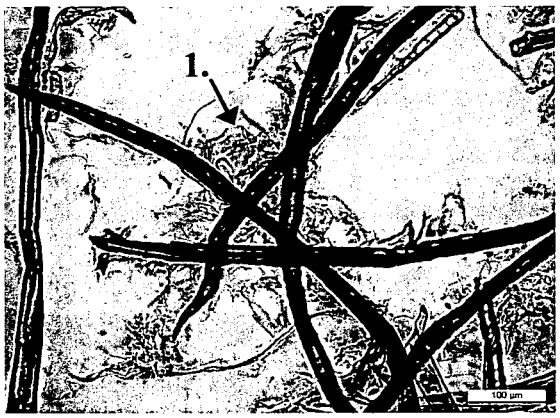
Figure 1:
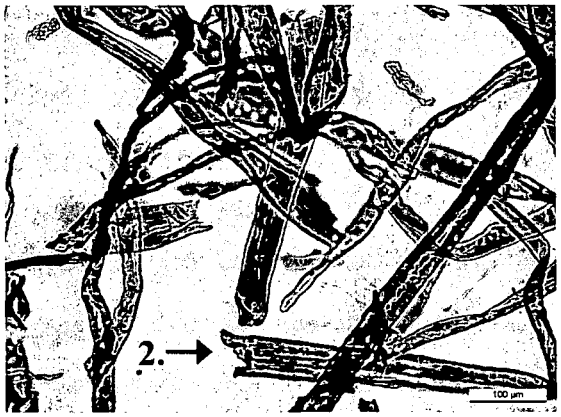

Image 1. Unrefined softwood fibers.

Image 2. Refined softwood fibers.

Image 3. Cut softwood fibers

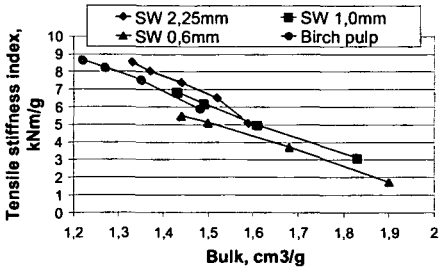
Figure 2. *Bulk - tensile stiffness index relationship.*
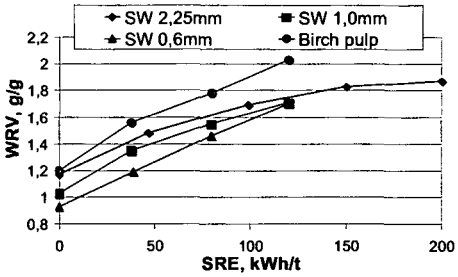
Figure 3. *SRE – WRV relationship.*
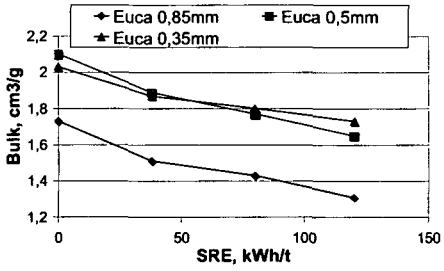
Figure 4. *SRE – bulk relationship.*
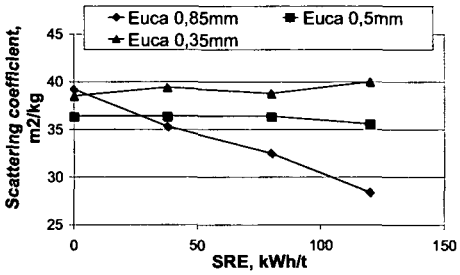
Figure 5. *SRE – scattering coefficient relationship.*

METHOD OF MAKING PAPER

This application is a U.S. National Stage under 35 U.S.C. §371 of International Application No. PCT/FI2010/000042, filed Jun. 17, 2010, which claims priority from Finish Patent Application No. 20095697, filed Jun. 18, 2009.

TECHNICAL FIELD

The invention relates to paper making technology and concerns treatment of cellulose pulp to be used in the preparation of paper. In more detail, the invention concerns mechanical treatment of pulp.

BACKGROUND

A broad range of cellulosic fibers are used in paper making processes. The fiber length has a strong impact on the properties of the produced paper.

In the art, long fibers are considered to give bulk and strength to the produced paper while shorter fibers give opacity, smoothness and good formation. Hard-wood pulp has short fiber lengths, usually around 1 mm, and is especially suited for producing smooth papers like printing, writing and copy paper. Softwood pulp has longer fibers, typically 2-3 mm long, and is therefore suited for production of magazine paper and linerboard.

The accessibility and price of wood fibre species vary over time, which gives rise to an uncertainty to the pulp producer. Moreover, it would be desirable to adapt the properties of the pulp to the paper qualities desired without needing to exchange the raw material.

Before pulp enters the paper making process, the pulp is oftentimes subjected to mechanical actions, such as refining. In refining (or beating), pulp is ground in order to modify the fiber structure. Impacting or cutting forces are tried to be avoided. During refining, fibrillation is developed, the water retention is increased and the freeness is decreased. The strength is always increased in refining.

At least low-consistency refining is known to shorten fibers somewhat. U.S. Pat. No. 6,361,650 describes a refining process, in which the average fiber length of TMP is reduced by 10-25%. Freeness was radically decreased (CSF from 90 ml to 30 ml), and tensile strength was quite essentially increased (from 40 $N/m^2$ to 52 $N/m^2$).

Dry defibering of dried pulp or paper has been found to detrimentally affect the papermaking potential of the defibered pulp. To study this further, a study was performed wherein dried chemical softwood pulp, a mixture of chemical softwood and hardwood pulp and CTMP were defibered with a hammer mill (Yli-Viitala P. et al., Appita 2006, pp. 75-80). The aim of this study was to defiber dried pulps (dry content round 95%), while maintaining fiber length and strength properties. In the refining of chemical pulps, the fiber length and the tensile strength were unaffected, while the tear strength was somewhat decreased. CTMP fibers were shortened from 2.25 mm to 1.75 mm (i.e. about 22%) and, consequently, the tensile strength and the tear strength of the pulp were decreased. Regarding the other pulps, no essential shortening of the fibers was observed. The screen aperture size (located at the bottom of the mill) did not affect the fiber length, at least not for the mixed softwood pulp. One of the conclusions of the study was that poor pulp properties seem to be caused by fiber cutting.

Fibrillation of pulp in a dry state has also been studied (Grandmaison E. W. and Gupta A., Tappi Journal August 1986, pp. 110-113). Since dry-formed products were considered in said study, the goal was to maintain the fiber length and the adequate strength of the pulp. The study showed that it is possible to produce fibrillated softwood pulp having only 15% shorter fibers than the reference pulp. The studied fibrillation system was not suitable for hardwood pulps, since the fiber length decreased too much (appr. 50%).

EP 979 895 A1 describes a method for refining fibers, in which method an extruder type apparatus is used for shortening the fibers.

In the art, cellulosic fiber pulp has also been pulverized for different purposes. Such pulverized pulp has, for example, been used or proposed to be used as an additive in papers. The amount of such an additive is at most a few per cents by weight of the paper.

SUMMARY OF THE INVENTION

A method of making paper or paper board, paper or paper board, pulp and the use of cut pulp have now been invented. In the method, a stock comprising cellulosic fiber pulp is prepared and a web is formed from the stock, comprising preparing cut pulp by cutting a basic cellulosic fiber pulp at the a consistency of at least 25% so that the an average fiber length of the basic cellulosic fiber pulp is decreased by more than 25% and the a Schopper Riegler (SR) number of the cut pulp is at most 20% higher than that of the basic cellulosic fiber pulp, and using the cut pulp as a raw material in the preparation of the stock. Some preferable embodiments of the invention are described herein below.

The basic idea of the present invention is to use cut fiber pulp as a web forming raw material in paper or paper board.

The cut pulp in accordance with the invention has been prepared from a basic pulp by cutting at the consistency of at least 25% so that its average fiber length is decreased by more than 25% and the SR number of the cut pulp is at most 20% higher than that of the basic pulp.

The invention enables paper and board makers to shorten fibers to a desired fiber length. This technique offers possibilities to improve the quality of paper and paper board products, to render the production more effective, and to decrease raw material dependency.

It has surprisingly been shown that pulp comprising cut fibers according to the invention gives rise to better dewatering and higher bulk compared to an uncut pulp.

DETAILED DESCRIPTION OF THE INVENTION

The pulp used as a starting material in the invention, also referred to as the basic pulp, is preferably wood pulp. The basic pulp may be chemical pulp, such as kraft pulp, or mechanical pulp, such as thermo mechanical or chemithermo mechanical pulp, or a mixture thereof. The basic pulp may be pulp containing virgin fibers, or pulp made from mill broke, such as machine broke, dry broke and/or coated broke, or pulp made from recovered fibers.

The average fiber length of the pulp in accordance with the invention is decreased by more than 25%, typically by more than 30%, such as by more than 50%. The average fiber length is preferably decreased no more than 90%, more preferably no more than 80%. Preferably, the average fiber length of cut fibers in accordance with the invention is higher than 0.2 mm.

The consistency of the pulp led to the cutting is at least 25%. Preferably, the consistency is at least 40%, more preferably at least 60%, even more preferably at least 80%, and most preferably 85-95%. Dry fibers are stiff and fragile, which makes it possible to cut fibers efficiently and with minor fibrillation. The energy consumption needed for cutting of fibers is medium low.

It has been found that, unlike wet pulp refining, cutting in accordance with the invention does not decrease bulk or increase water retention. Moreover, in cutting, the impact on optical properties, e.g. light scattering, is at least significantly smaller compared to wet refining.

In the method in accordance with the invention, pulp is cut in a cutting process so that its average fiber length decreases. In a cutting process, a cutting apparatus is used. Such an apparatus comprises one or more cutting blades, with which fibers are cut. A relatively high impact force is preferably used in cutting. Grinding of fibers is avoided in the cutting. The apparatus may comprise a rotor with cutting blades surrounded by a chamber having counterblades on its inner surface.

The strength of the pulp is usually decreased in the cutting process.

The freeness value of the cut pulp is preferably substantially the same as that of the basic pulp. If the freeness is decreased in the cutting process, the decrease is preferably at the most 10%, more preferably at most 5%.

Correspondingly, the Schopper-Riegler number, also referred to as the SR number, is preferably not increased or increased as little as possible in the cutting. The increase of the SR number is at most 20%, more preferably at most 10%, and most preferably at most 5%.

The water retention value of the pulp is preferably decreased in the cutting. The decrease of the water retention value is preferably at least 5%, more preferably at least 8%.

The bulk of the cut pulp is preferably substantially the same or higher as that of the basic pulp.

The fibrillation degree of the fibers of the cut pulp is preferably substantially the same as that of the basic pulp.

Chemicals, which for example improve the flow of the pulp in the cutting process, may be used, when desired. However, modifying chemicals, such as crosslinking agents or like, are preferably not used.

The amount of the cut pulp is preferably at least 5% by weight of the total amount of pulp in the paper or paper board, more preferably at least 10%, and most preferably at least 20%.

In one preferred embodiment of the invention, the cut pulp is used as a raw material in the preparation of a stock, and a web is formed from the stock by a wet web forming process.

The cut pulp may be refined after cutting.

One of the main advantages of the invention is that from a certain pulp material it is possible to get modified pulp material, which has shorter fiber length but is otherwise still suitable for use in paper or paper board.

The average fiber length of cut softwood pulp may be e.g. 0.2-1.8 mm, and of cut hardwood pulp e.g. 0.2-0.8 mm.

The invention makes it possible to obtain usable pulps with fiber lengths that cannot at all be obtained with conventional methods without affecting other pulp properties negatively. Moreover, it is possible to obtain pulps with specified fiber length distributions. Cutting of the fibers in accordance with the invention makes it, for example, possible to obtain a narrower fiber length distribution. These new types of pulps provide new possibilities in paper development.

The average fiber length obtained by the cutting process can easily be controlled, e.g. by choosing the slot size of the screen in the screening. In this way, a pulp manufacturer can easily produce pulp grades with different fiber lengths from one, single, raw material.

One specific use of the invention is to cut softwood pulp and to use such cut pulp instead of hardwood pulp in the manufacturing of products where hardwood pulp is conventionally used. Thus e.g. birch or eucalyptus pulp can be replaced with cut pulp in fine papers and paper boards.

EXAMPLES

In the following examples, pulps were cut in a laboratory-scale Wiley-mill (model no. 2). The mill has a rotor with four sharp blades surrounded by a chamber with six sharp counterblades. The gap between the blades is about 0.1-0.3 mm. The diameter of the chamber is 20 cm and the length 7.5 cm. The rotation speed is 850 rpm. The feed is from above and the output from below through a screen. Inside the mill the blades degrade the pulp sheets and cut the fibers. Cut fibers leave through the screen located at the bottom of the mill. By choosing the slot size of the screen, the average fiber length can be controlled.

The average fiber lengths were measured with a Kajaani FS300 device (Metso Automation).

Cut pulps were refined in a Voith Sulzer refiner with disk fillings.

Handsheets were made of the refined pulps according to standard ISO 5269-1.

Example 1

Cutting of Softwood Pulp

Dried softwood (SW) pulp (mill dried pulp, mainly from pine, average fiber length 2.25 mm) was cut to average fiber length of 1.0 mm and 0.6 mm by using slot dimensions 6 mm and 2 mm respectively. The pulps were treated two times. The cut pulps were refined like hardwood pulps with a specific edge load 0.5 J/m.

The structure of the fibers was studies with a light transmission microscope. Pictures are shown in FIG. 1. Image 1 shows untreated fibers, Image 2 refined uncut fibers, and Image 3 cut fibers.

As shown in FIG. 1, the fiber form of refined fibers is clearly different from unrefined fibers (collapsed, deformations etc.). External fibrillation can be clearly seen in the fiber surface (1). Cutting (2.) has occurred relatively sharply. The cutting has not fibrillated the fibers.

Compared to reference SW pulp of fiber length 2.25 mm, cut SW pulps have lower water retention value (improved dewatering) and higher bulk (FIGS. 3 & 4). As can be seen in FIG. 5, optical properties (light scattering and opacity) are improved and remain clearly better in refining.

Compared to birch pulp, cut SW pulp with the same fiber length has clearly better dewatering (lower WRV) and higher bulk at a certain refining level (FIGS. 3 & 4). Although the strength properties (e.g. tensile stiffness index) are initially lower, it can be partly or even fully compensated by more intense refining if strength is needed (FIG. 2). Better dewatering and optical properties enable more intense refining. It may thus be possible to replace birch pulp with cut SW pulp and to improve the quality and paper machine dewatering of fine paper and board products.

Example 2

Cutting of Eucalyptus Pulp

Dried eucalyptus (euca) pulp (mill dried pulp, average fiber length 0.85 mm) was cut to average fiber length of 0.5 mm and 0.35 mm by using slot dimensions 2 mm and 1 mm respectively. The pulps were treated once. Both reference and cut pulps were refined with specific edge load 0.4 J/m. Cut eucalyptus pulps have clearly better dewatering (lower WRV and SR number) and higher bulk (FIG. 4). Optical properties (light scattering, opacity and brightness) do not decrease in refining contrary to reference pulps (FIG. 5). Strength properties (e.g. tensile stiffness index) are lower for cut pulps, but it can be partly compensated by more intense refining if needed. It might be possible to improve quality of some paper products and improve dewatering at the paper machine by using cut eucalyptus pulp instead of regular eucalyptus pulp.

Example 3

Comparison Between Cut Fibers and Refined SW Fibers

TABLE 1

Comparison between cut SW fibers and unrefined and refined SW fibers

| | SW pulp | Cut SW pulp | Cut SW pulp | SW pulp | SW pulp refined in LC-refiner | SW pulp | SW pulp refined in LC-refiner |
|---|---|---|---|---|---|---|---|
| Fiber length (l), mm | 2.25 | 1 | 0.6 | 2.25 | 2.20 | 2 | 1.2 |
| Specific energy consumption in refining, kWh/t | 0 | 0 | 0 | 0 | 150 | 0 | 50 |
| SR number | 15 | 15 | 15 | 15 | 28 | 15 | 19 |
| CSF, ml | 660 | 660 | 640 | 660 | 430 | 630 | 550 |
| WRV, g/g | 1.17 | 1.03 | 0.92 | 1.17 | 1.83 | | |
| Bulk, $cm^3/g$ | 1.59 | 1.83 | 1.82 | 1.59 | 1.37 | 1.69 | 1.54 |
| Tensile index, Nm/g | 42 | 18 | 11 | 42 | 92 | | |

Table 1 shows the impact on pulp-quality of the cutting process according to the invention compared to conventional LC refining and high impact LC-refining.

The fiber length of SW pulp can be decreased to ca. 1.2 mm with conventional LC refining. However, conventional LC refining gives rise to an increase in SR number (at least 25%) and a decrease in bulk (at least 9%). A further problem when the fiber length is decreased in conventional refining of pulp is that the refiner plates are quickly worn and that the process is hard to control. These problems, as well as the negative effects on the pulp quality, can be avoided by decreasing the fiber length in accordance with the invention.

Example 4

Replacement of Birch Pulp in Top Plies of Board by Cut SW Pulp

Three-ply boards were simulated with sheets made by dynamic sheet former. In the reference sheets, the top plies included 70% birch pulp and 30% SW pulp. The birch pulp was refined with specific refining energy 15 kWh/t to reach SR number ca. 20. In addition, sheets were made where the birch pulp in top plies were replaced by cut SW pulp having average fiber length of 0.6 mm. Cut softwood pulp was refined with higher specific refining energy (100 kWh/t) than birch pulp to have strength properties closer to birch pulp.

TABLE 2

Properties of three-ply reference board (A) and board (B), where cut SW fibers where used in top-plies

| | Board A | Board B |
|---|---|---|
| Grammage, $g/m^2$ | 281 | 272 |
| Bulk, $cm^3/g$ | 1.81 | 1.82 |
| Formation, st. dev. | 8.7 | 8.3 |
| Scott bond, MD/CD, J/m2 | 193/190 | 212/217 |
| Resistance to bending, MD | 627 | 562 |
| Tensile stiffness index, MC/CD, kNm/g | 7.78/2.62 | 8.08/2.42 |
| Roughness bendtsen, TS/BS, ml/min | 1473/1328 | 1513/1541 |
| Air resistance, Gurley, s | 20 | 38 |

According to the results (Table 2), it seems to be possible to replace birch pulp in top plies of board by cut SW pulp. Differences in the results were mostly within standard deviation of the measurements. It is worth of noting that the basis weight of the reference board was 3% higher compared to the board including cut SW pulp in top plies.

The invention claimed is:

1. A method of making a paper or paper board, in which method a stock comprising cellulosic fiber pulp is prepared and a web is formed from the stock, comprising preparing cut pulp by cutting a basic cellulosic fiber pulp at a consistency of at least 25% so that an average fiber length of the basic cellulosic fiber pulp is decreased by more than 25% and a Schopper Riegler (SR) number of the cut pulp is at most 20% higher than that of the basic cellulosic fiber pulp, and using the cut pulp as a raw material in the preparation of the stock.

2. A method according to claim 1, wherein the amount of the cut pulp is at least 5 weight-% of the total amount of the cellulosic fiber pulp in the stock.

3. A method according to claim 1 further comprising forming the web by a wet forming process.

4. A method according to claim 1, further comprising refining the cut pulp before preparing the stock.

5. The method according to claim 1 wherein the average fiber length is decreased by more than 50%.

6. The method according to claim 1, wherein the basic cellulosic pulp is cut at the consistency of at least 40%.

7. The method according to claim 1 wherein a freeness value of the cut pulp is substantially the same as that of the basic cellulosic pulp.

8. The method according to claim 1 wherein the SR number of the cut pulp is at most 10% higher than that of the basic cellulosic pulp.

9. The method according to claim 1 wherein a water retention value of the cut pulp is substantially the same or lower than that of the basic cellulosic pulp.

10. The method according to claim 1 wherein a bulk of the cut pulp is substantially the same or higher than that of the basic cellulosic pulp.

11. The method according to claim 1, wherein a fibrillation degree of the fibers of the cut pulp is substantially the same as that of the basic cellulosic pulp.

12. The method according to claim 1 wherein the basic cellulosic pulp is softwood pulp and the average fiber length of the cut pulp is 0.2-1.8 mm, or the basic cellulosic pulp is hardwood pulp and the average fiber length of the cut pulp is 0.2-0.8 mm, or the basic cellulosic pulp is a mixture of said softwood pulp and said hardwood pulp.

13. The method according to claim 1 wherein the basic cellulosic pulp contains virgin fiber pulp, broke pulp, or mixtures thereof.

14. A method of making a paper or paper board, in which method a stock comprising cellulosic fiber pulp is prepared and a web is formed from the stock, comprising preparing cut pulp by cutting a basic cellulosic fiber pulp at a consistency of at least 40% so that an average fiber length of the basic cellulosic fiber pulp is decreased by more than 30% and a Schopper Riegler (SR) number of the cut pulp is at most 20% higher than that of the basic cellulosic fiber pulp, and using the cut pulp as a raw material in the preparation of the stock, wherein the amount of the cut pulp is at least 10 weight-% of the total amount of the cellulosic fiber pulp in the stock.

15. A method according to claim 14, further comprising forming the web by a wet forming process.

16. A method according to claim 14, further comprising refining the cut pulp before preparing the stock.

17. The method according to claim 14, wherein the average fiber length is decreased by more than 50%.

18. The method according to claim 14, wherein the basic cellulosic pulp is cut at the consistency of at least 60%.

19. The method according to claim 14, wherein the SR number of the cut pulp is at most 10% higher than that of the basic cellulosic pulp.

20. The method according to claim 14, wherein the basic cellulosic pulp is softwood pulp and the average fiber length of the cut pulp is 0.2-1.8 mm, or the basic cellulosic pulp is hardwood pulp and the average fiber length of the cut pulp is 0.2-0.8 mm, or the basic cellulosic pulp is a mixture of said softwood pulp and said hardwood pulp.

* * * * *